United States Patent [19]

Taylor

[11] Patent Number: 4,832,238

[45] Date of Patent: May 23, 1989

[54] OIL SPOUT

[76] Inventor: Charles M. Taylor, 10461 Wentworth Springs Rd., Georgetown, El Dorado, Calif. 95634

[21] Appl. No.: 178,306

[22] Filed: Apr. 6, 1988

[51] Int. Cl.[4] ..... B67C 11/04

[52] U.S. Cl. ..... 222/529; 222/568; 141/337; 251/65; 251/305

[58] Field of Search ..... 222/529, 568, 537, 548, 222/460, 541; 141/337, 339, 331, 334, 335; 251/65, 305

[56] References Cited

U.S. PATENT DOCUMENTS

| | | | |
|---|---|---|---|
| 612,510 | 10/1898 | Walker | 141/335 |
| 2,556,627 | 6/1951 | Miksis | 222/568 |
| 2,672,257 | 3/1954 | Simmonds | 251/65 |
| 2,949,931 | 8/1960 | Ruppright | 251/65 |
| 4,129,236 | 12/1978 | Wrycraft et al. | 222/568 |
| 4,426,027 | 1/1984 | Maynard | 222/529 |
| 4,583,668 | 4/1986 | Maynard | 222/529 |
| 4,600,125 | 7/1986 | Maynard, Jr. | 222/529 |
| 4,706,720 | 11/1987 | Pattison et al. | 141/339 |

*Primary Examiner*—Andres Kashnikow
*Assistant Examiner*—Karen B. Merritt
*Attorney, Agent, or Firm*—Jerry T. Kearns

[57] ABSTRACT

An elongated flexible oil spout has one end portion provided with internal threads for engagement with external threads of a plastic oil bottle. An intermediate portion of the oil spout is formed from accordion fold snap-lock segments which connect to a conical tip portion. A snap-on cap is provided at each end of the oil spout for preventing leakage. A butterfly valve adjacent the threaded end portion of the oil spout allows the flow to be regulated. An adaptor is provided with opposite end portions having different diameter external threads for engagement with internal threads of an oil drain aperture on an engine block and with the internal threads of the oil spout. A butterfly valve is disposed intermediate these threaded ends for controlling flow from the engine block. The adapter is utilized in conjunction with the flexible oil spout to allow oil to be drained without spillage from the engine block. The butterfly valve in the oil spout and in the adapter cooperates with valve seats which may be formed integrally with the oil spout or adapter, or may be formed from inserts. The valve seat and butterfly valve may have cooperating magnetic portions for maintaining the valve in a closed position.

10 Claims, 3 Drawing Sheets

OIL SPOUT

BACKGROUND OF THE INVENTION

1. Field of the Invention

The present invention relates to oil spouts, and more particularly pertains to a new and improved flexible oil spout with a butterfly flow control valve. Motor oil is currently marketed in an increasingly popular blow molded plastic bottle with a reclosable threaded cap. These plastic bottles have an opening with a 28 millimeter externally threaded neck portion. This plastic bottle is not dimensioned to allow oil to be easily poured without spillage into a variety of different oil fill apertures in internal combustion engines. In order to solve this problem, the present invention provides an elongated flexible spout which has one end portion provided with 28 millimeter internal threads for cooperation with the external threads of the oil bottle. Additionally, in order to allow the oil flow through the spout to be precisely regulated, the present invention provides a butterfly valve. An additional problem presented by the prior art is the draining of oil from small internal combustion engines such as lawn mowers, without creating messy oil spills. In order to overcome this problem, the present invention provides an adaptor having one end provided with external 17 millimeter threads for engagement with internal threads of an oil drain aperture in an engine block and an opposite end provided with 28 millimeter external threads for engagement with the internal threads of the elongated flexible oil spout. A butterfly valve is provided between these threaded portions for controlling the oil flow from the engine block. Thus, the present invention provides an oil spout system which allows oil to be drained from small internal combustion engines such as those typically utilized on lawn mowers, without creating messy oil spills.

2. Description of the Prior Art

Various types of oil spouts are known in the prior art. A typical example of such an oil spout is to be found in U.S. Pat. No. 4,426,027, which issued to W. Maynard on Jan. 17, 1984. This patent discloses an elongated flexible pouring spout for liquid containers adapted to reach fill points without employing a funnel. The spout, when inverted, stores within the liquid container and is effectively sealed with the container neck in both the pouring and stored positions. A single threaded cover cap can engage threads on either ends of the pouring spout to prevent leakage. U.S. Pat. No. 4,583,668, which issued to W. Maynard on Apr. 22, 1986, discloses a threaded elongated flexible pouring spout which is detachably connectable with the threaded outlets of variously sized liquid containers by means of a multi-threaded adaptor having threaded sleeve portions of different diameters, one of which at each end of the adaptor is engagable with the threads of the flexible spout. A threaded extension cap for the flexible spout enables the servicing of small openings requiring liquids. The extension cap can also be threadedly engaged with the outlets of certain liquid containers. The device is specifically adapted for use with plastic blow molded bottles of the type utilized for storing and dispensing motor oil, anti-freeze, transmission fluid and other automotive fluids.

While the above mentioned devices are suited for their intended usage, none of these devices provide an elongated flexible pouring spout which utilizes a butterfly valve for controlling fluid flow through the spout.

An additional feature of the present invention, not disclosed by the aforesaid prior art devices, is the use of an adaptor provided with different externally threaded ends for engagement with an oil drain aperture of an internal combustion engine and a threaded end portion of an elongated flexible pouring spout in conjunction with a butterfly valve for draining oil from an internal combustion engine in a controlled manner without spillage. Inasmuch as the art is relatively crowded with respect to these various types of oil spouts, it can be appreciated that there is a continuing need for and interest in improvements to such oil spouts, and in this respect, the present invention addresses this need and interest.

SUMMARY OF THE INVENTION

In view of the foregoing disadvantages inherent in the known types of oil spouts now present in the prior art, the present invention provides an improved oil spout. As such, the general purpose of the present invention, which will be described subsequently in greater detail, is to provide a new and improved oil spout which has all the advantages of the prior art oil spouts and none of the disadvantages.

To attain this, representative embodiments of the concepts of the present invention are illustrated in the drawings and make use of an elongated flexible oil spout having one end portion provided with internal threads for engagement with external threads of a plastic oil bottle. An intermediate portion of the oil spout is formed from accordion fold snap-lock segments which connect to a conical tip portion. A snap-on cap is provided at each end of the oil spout for preventing leakage. A butterfly valve adjacent the threaded end portion of tee oil spout allows the flow to be regulated. An adaptor is provided with opposite end portions having different diameter external threads for engagement with internal threads of an oil drain aperture on an engine block and with the internal threads of the oil spout. A butterfly valve is disposed intermediate these threaded ends for controlling flow from the engine block. The adapter is utilized in conjunction with the flexible oil spout to allow oil to be drained without spillage from the engine block. The butterfly valves in the oil spout and in the adapter cooperates with valve seats which may be formed integrally with the oil spout or adapter, or may be formed from inserts. The valve seat and butterfly valve may have cooperating magnetic portions for maintaining the valve in a closed position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oil spout which has all the advantages of the prior art oil spouts and none of the disadvantages.

It is another object of the present invention to provide a new and improved oil spout which may be easily and efficiently manufactured and marketed.

It is a further object of the present invention to provide a new and improved oil spout which is of a durable and reliable construction.

An even further object of the present invention is to provide a new and improved oil spout which is susceptible of a low cost of manufacture with regard to both materials and labor, and which accordingly is then susceptible of low prices of sale to the consuming public, thereby making such oil spouts economically available to the buying public.

Still yet another object of the present invention is to provide a new and improved oil spout which provides in the apparatuses and methods of the prior art some of the advantages thereof, while simultaneously overcoming some of the disadvantages normally associated therewith.

Still another object of the present invention is to provide a new and improved oil spout which has an elongated accordion fold snap-lock flexible portion enabling the oil spout to reach a wide variety of differently configured oil fill points.

Yet another object of the present invention is to provide a new and improved oil spout which is provided with a butterfly valve to regulate flow control.

Even still another object of the present invention is to provide a new and improved oil spout and adaptor provided with butterfly valves for draining oil from internal combustion engines without oil spillage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
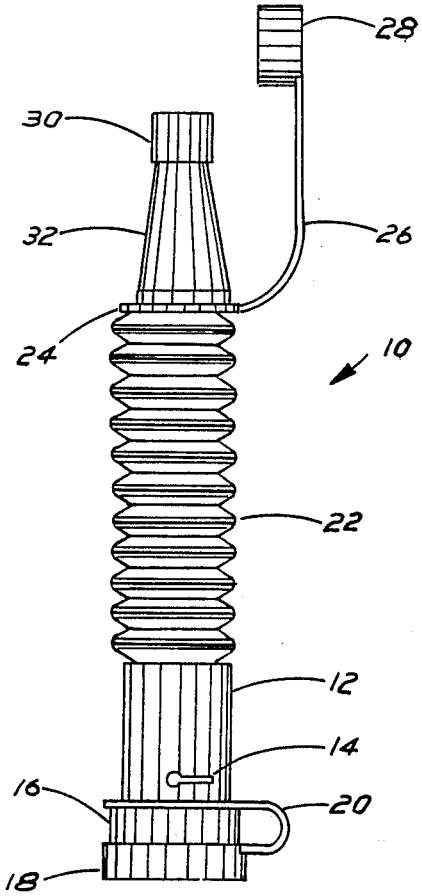
FIG. 1 is a side view of the oil spout of the present invention.

With reference now to the drawings, and in particular to FIG. 1 thereof, a new and improved oil spout embodying the principles and concepts of the present invention and generally designated by the reference numeral 10 will be described.

More specifically, it will be noted that the first embodiment 10 of the invention includes a hollow cylindrical base portion 12 having a stepped enlarged diameter end portion 16. A snap-on type cap 18 is secured by a flexible strap 20 to the hollow cylindrical tubular base portion 12. The cap 18 serves to prevent fluid leakage from the bottom end 16 of the spout 10. An external actuation lever 14 for a butterfly flow control valve within the hollow tubular portion 12 extends through an aperture in the cylindrical side wall of the tubular portion 12. An extendable snap-lock accordion fold section 22 is connected to a top portion of the hollow cylindrical tubular portion 12. The extendable section 22 is constructed of a plurality of snap-lock type adjacent segments which may be bent into a wide variety of configurations for enabling the oil spout 10 of the present invention to reach oil fill points which would be inaccessible to rigid oil spouts. A cap 28 for a top end portion 30 of the oil spout 10 is secured by a flexible strap 26 to a ring 24 which is engaged around the base of a conical end segment 32 of the oil spout 10. The cap 28 serves to prevent fluid leakage from the top end portion 30 of the oil spout 10.

Figure 2:
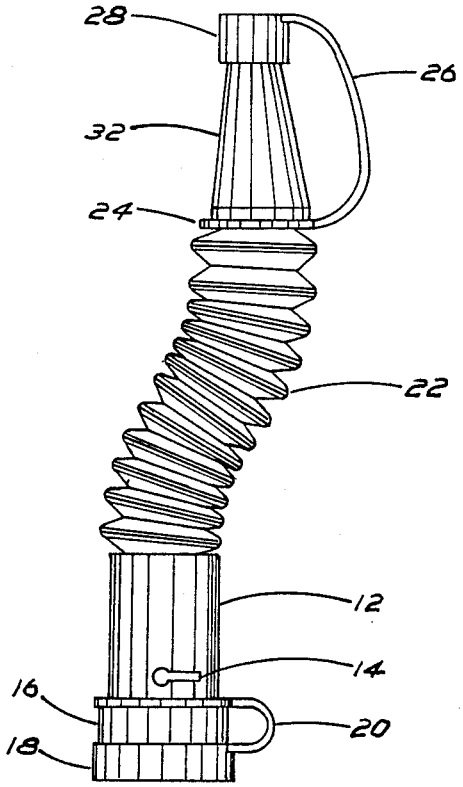
FIG. 2 is a side view of the oil spout of the present invention, illustrating the flexibility of the accordion fold extendable section.

In FIG. 2, the extendable section 22 is illustrated deformed to one possible configuration. The snap-lock nature of the extendable section 22 causes the oil spout 10 to remain in the desired deformed condition. The top cap 28 is illustrated in a closed position.

Figure 3:
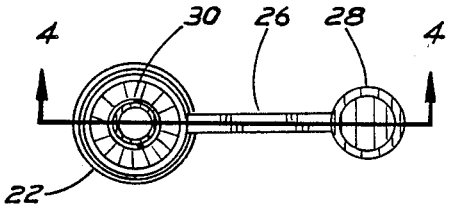
FIG. 3 is a top end view of the oil spout of the present invention, with the upper cap removed.

In FIG. 3, a top view of the oil spout 10 illustrates the cap 28 in an open position, removed from the top end portion 30 of the spout 10.

Figure 4:
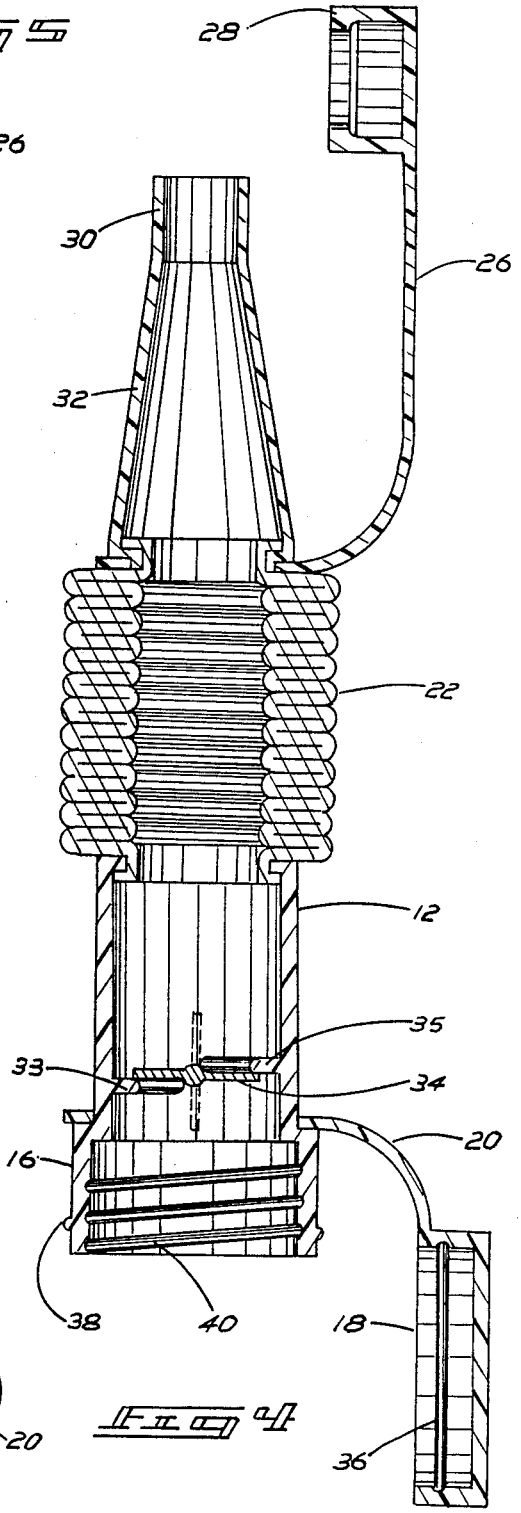
FIG. 4 is a longitudinal cross sectional view, taken along line 4—4 of FIG. 3, illustrating the internal construction of the oil spout of the present invention.

In FIG. 4, a longitudinal cross sectional view of the oil spout 10 of the present invention is provided. The extendable section 22 is illustrated in a fully compressed position. The hollow tubular portion 12 is provided with an integrally formed valve seat which is compose of two axially staggered semicircular flanges 33 and 35. A circular butterfly valve 34 engages opposite axial sides of the flanges 33 and 35 when in the illustrated closed position. The butterfly valve 34 may be adjusted to a wide variety of different positions to selectively control the flow rate through the oil spout 10. The enlarged end section 16 is provided with internal twenty eight millimeter threads 40 for engagement with external twenty eight millimeter threads provided on standard oil bottle neck portions. A radially outwardly extending ridge 38 is formed on the enlarged diameter portion 16 for engagement with a circular groove 36 formed in the bottom end cap 18.

Figure 5:
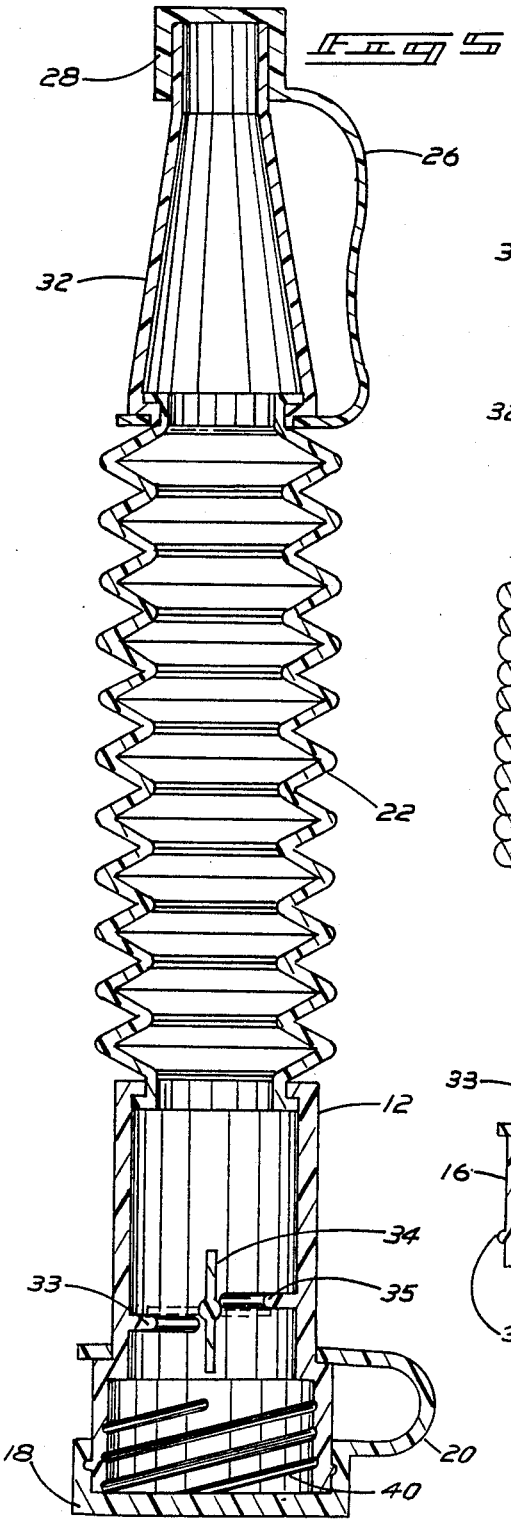
FIG. 5 is a longitudinal cross sectional view of the oil spout of the present invention in an extended condition.

In FIG. 5, another longitudinal cross sectional view of the oil spout 10 illustrates the extendable section 22 in an extended condition. The butterfly valve 34 is illustrated in an open position and the cap 18 is shown in a closed position.

Figure 6:
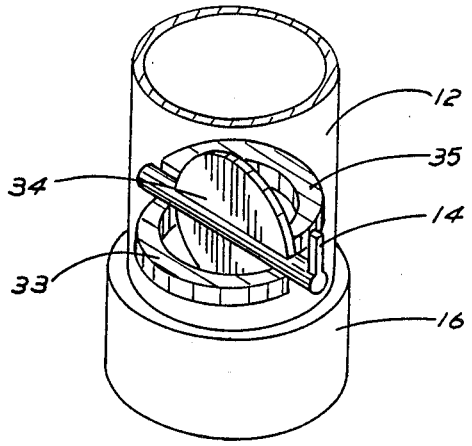
FIG. 6 is a diagrammatic perspective view illustrating an alternative form of butterfly flow control valve for use in the oil spout of the present invention.

With reference now to FIG. 6, a diagrammatic perspective view illustrates an alternative butterfly valve construction according to the present invention. The hollow tubular section 12 is provided with spaced axially staggered semicircular valve seat segments 33' and 35'. These segments are preferably formed from a permanent magnetic material and are inserted into spaced semicircular undercut grooves provided in the interior cylindrical side wall of the tubular portion 12. The circular butterfly valve 34 is formed from a ferrous material such that it will be maintained in a closed position by virtue of magnetic engagement with the valve seat portions 33' and 35'.

Figure 7:
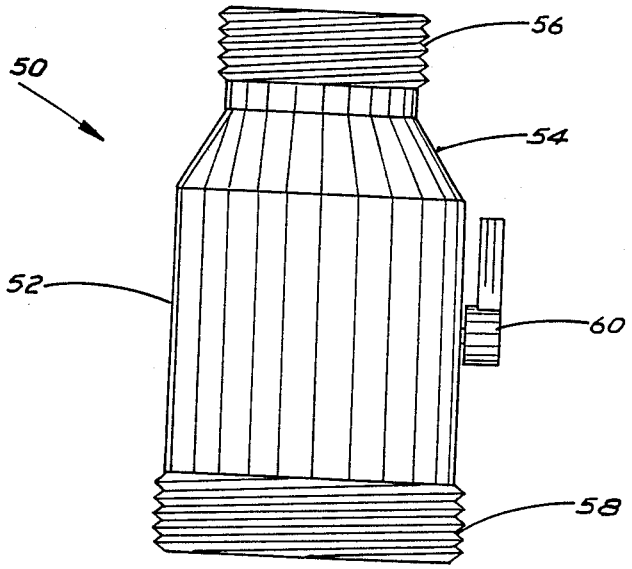
FIG. 7 is a side view of the adaptor for use in draining oil from small internal combustion engines such as lawn mower engines.

In FIG. 7, an adaptor according to the present invention is illustrated. The adaptor 50 has a first end provided with seventeen millimeter external threads 56 for engagement with the internal threads of an oil drain aperture in a small internal combustion engine such as a lawn mower engine. An opposite end of the adaptor 50 is provided with twenty eight millimeter external threads 58 for engagement with the internal threads 40 (FIG. 4) of the oil spout 10 of the present invention. A butterfly valve located in the interior of a cylindrical barrel portion 52 of the adaptor 50 is controlled by an external actuation lever 60. The construction of the butterfly valve of the adaptor 50 may be of the type illustrated in FIGS. 4 and 5, or may be of the type illustrated and described with reference to FIG. 6. In use, the threaded end 56 of the adaptor 50 is engaged with internal threads of an oil drain aperture of a lawn mower engine. The valve actuation lever 60 is moved to position the butterfly valve to a closed position. The threaded end 58 of the adaptor 50 is engaged with the internal threads 40 (FIG. 4) of the oil spout 10. The end 30 of the oil spout 10 is then inserted into a suitable receptacle and the lawn mower is tipped to drain the motor oil into the receptacle without spillage. If the receptacle becomes nearly full, the butterfly valve 60 may be closed while another receptacle is located.

Thus, the present invention provides a flexible oil spout with a flow control valve for both dispensing and draining oil from internal combustion engines.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oil spout, comprising:
- a cylindrical tubular hollow base;
- an enlarged diameter end portion on said base;
- internal threads formed in said end portion;
- a cap connected by a flexible strap to said base for closing said end portion;
- a valve seat in said hollow base;
- a butterfly valve mounted for rotation in said base and adapted to seat in a closed position on said valve seat;
- an external actuation lever extending through a cylindrical sidewall of said base for actuating said butterfly valve;
- a hollow tubular extendable accordion fold intermediate section formed from a plurality of adjacent snap-lock segments having a first end connected to said base;
- a conical tapered tubular end segment connected to a second end of said intermediate section;
- a cap for closing said conical end segment secured by a flexible strap attached adjacent said second end of said intermediate section;
- an adapter for securing said oil spout to an oil drain aperture of an internal combustion engine, said adapter having a hollow tubular cylindrical body portion;
- a first diameter threaded end on said body portion for engagement with internal threads of an oil drain aperture;
- a second larger diameter threaded end on said body portion for engagement with said internal threads of said oil spout; and
- a butterfly valve having an external manually actuated lever in said body portion, intermediate said first and second ends.

2. The oil spout of claim 1, wherein said valve seat comprises two axially staggered semicircular flanges in said hollow base.

3. The oil spout of claim 2, wherein said flanges are formed integrally with said base.

4. The oil spout of claim 2, wherein said flanges are formed by two inserted semicircular segments secured in axially staggered undercut grooves within said base.

5. The oil spout of claim 4, wherein said segments are permanent magnets and said butterfly valve is formed from a ferrous material.

6. A system for draining oil from small internal combustion engines, comprising:
- a cylindrical tubular hollow base;
- an enlarged diameter end potion on said base;
- internal threads formed in said end portion;
- a cap connected by a flexible strap to said base for closing said end portion;
- a valve seat in said hollow base;

a butterfly valve mounted for rotation in said base and adapted to seat in a closed position on said valve seat;

an external actuation lever extending through a cylindrical sidewall of said base for actuating said butterfly valve;

a hollow tubular extendable accordion fold intermediate section formed from a plurality of adjacent snap-lock segments having a first end connected to said base;

a conical tapered tubular end segment connected to a second end of said intermediate section;

a cap for closing said conical end segment secured by a flexible strap attached adjacent said second end of said intermediate section;

adapter means for securing said enlarged diameter end portion of said base to an oil drain aperture of an internal combustion engine, said adapter means comprising:

a hollow tubular cylindrical body portion;

a first diameter threaded end on said body portion for engagement with internal threads of an oil drain aperture;

a second larger diameter threaded end on said body portion for engagement with said internal threads of said enlarged diameter end portion of said base; and a butterfly valve having an external manually actuated lever in said body portion, intermediate said first and second ends.

7. The device of claim 6, wherein said flanges are formed integrally with said base.

8. The device of claim 6, wherein said valve seat comprises two axially staggered semicircular flanges in said hollow base.

9. The device of claim 8, wherein said flanges are formed by two inserted semicircular segments secured in axially staggered undercut grooves within said base.

10. The device of claim 8, wherein said segments are permanent magnets and said butterfly valve is formed from a ferrous material.

* * * * *